United States Patent [19]

Cotta

[11] Patent Number: 4,721,240

[45] Date of Patent: Jan. 26, 1988

[54] CAM-CONTROLLED SELF-CONTAINED INTERNAL COMBUSTION FASTENER DRIVING TOOL

[75] Inventor: Gilbert A. Cotta, Cincinnati, Ohio

[73] Assignee: Senco Products, Inc., Cincinnati, Ohio

[21] Appl. No.: 881,343

[22] Filed: Jul. 2, 1986

[51] Int. Cl.[4] ..... B25C 1/08

[52] U.S. Cl. ..... 227/10; 60/633; 123/46 SC; 227/9

[58] Field of Search ..... 227/9, 10; 60/632, 633; 123/46 SC

[56] References Cited

U.S. PATENT DOCUMENTS

| | | | |
|---|---|---|---|
| 3,042,008 | 7/1962 | Liesse | 227/10 |
| 4,200,213 | 4/1980 | Liesse | 227/10 |
| 4,403,722 | 9/1983 | Nicholich | 227/8 |
| 4,483,473 | 11/1984 | Wagely | 123/46 SC |

FOREIGN PATENT DOCUMENTS

| | | | |
|---|---|---|---|
| 2060768 | 5/1981 | United Kingdom | 227/9 |

*Primary Examiner*—Paul A. Bell
*Assistant Examiner*—James L. Wolfe
*Attorney, Agent, or Firm*—Frost & Jacobs

[57] ABSTRACT

A fastener driving tool powered by internal combustion of an air/fuel mixture. The tool body contains connected upper and lower coaxial cylinders. The upper cylinder is provided with a piston assembly and is connected by a one-way valve to a combustion air chamber. The lower cylinder contains a piston/driver assembly and is surrounded by and connected to a return air chamber. The upper cylinder piston assembly and the lower cylinder piston/driver assembly, when in their normal unactuated positions, define therebetween a combustion chamber provided with an ignition device. A positive trigger-actuated cam system, upon actuation of the trigger, is configured to open a fuel valve to introduce a measured amount of gaseous fuel from a source thereof into the combustion chamber; to thereafter open an air valve to introduce a measured quantity of air from the combustion air chamber into the combustion chamber; to next actuate the ignition device to combust the aire fuel mixture causing the lower cylinder piston/driver assembly to drive a fastener and to fill the return air chamber with air under pressure in the upper cylinder piston assembly to replenish air under pressure in the combustion air chamber; and finally to actuate a control valve operating an exhaust valve eliminating products of combustion enabling the upper cylinder piston assembly to return to its normal position and air from the return air chamber to return the lower cylinder piston/driver assembly to its normal position.

22 Claims, 12 Drawing Figures

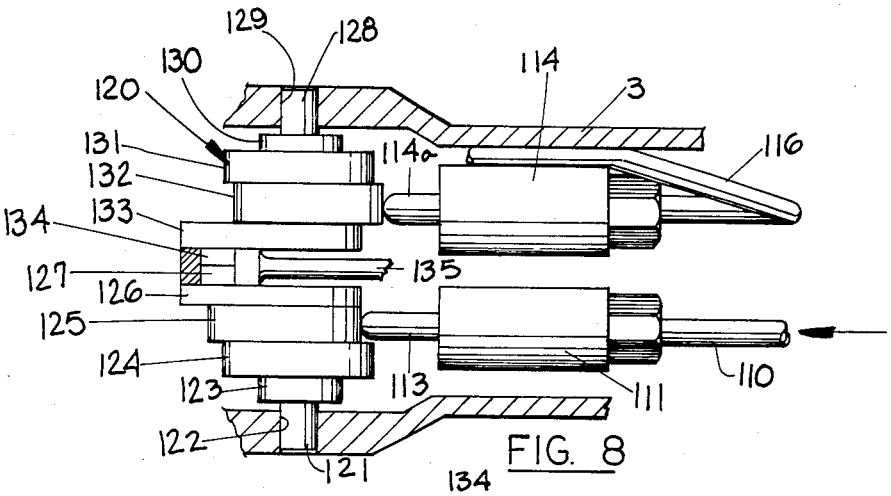
FIG. 8
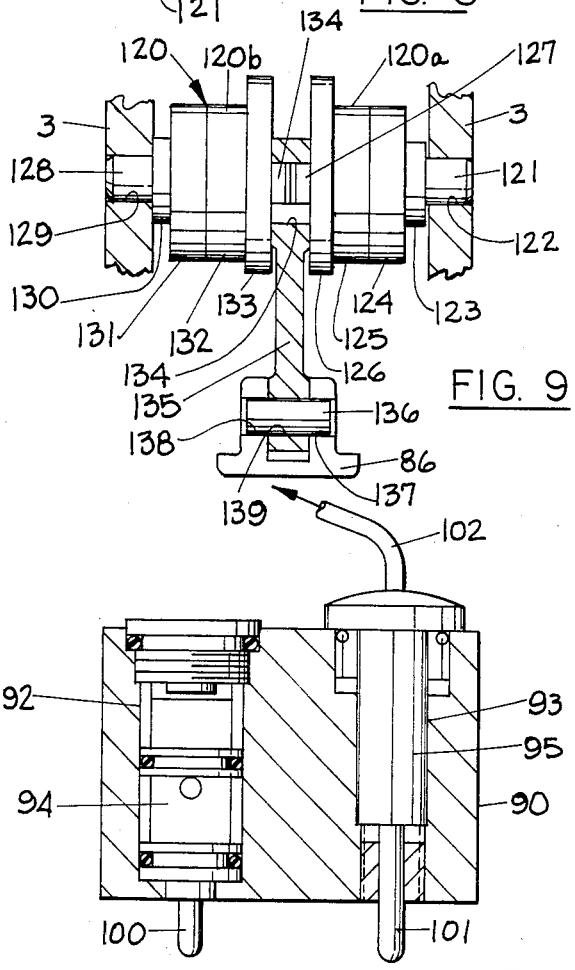
FIG. 9
FIG. 10

CAM-CONTROLLED SELF-CONTAINED INTERNAL COMBUSTION FASTENER DRIVING TOOL

REFERENCE TO RELATED APPLICATIONS

The present invention, is related to co-pending application Ser. No. 06/881,339 filed July 2, 1986. in the name of the same inventor and entitled SELF-CONTAINED INTERNAL COMBUSTION FASTENER DRIVING TOOL; and to co-pending application Ser. No. 06/881,337, filed in the name of the same inventor and entitled SIMPLIFIED SELF-CONTAINED INTERNAL COMBUSTION FASTENER DRIVING TOOL.

TECHNICAL FIELD

The invention relates to a self-contained internal combustion fastener driving tool, and more particularly to such a tool having a positive-control cam system with simple two-way valves to actuate the full cycle of the tool by actuation of a trigger, and having an air compressing system to provide air under pressure for combustion, to actuate the exhaust valve to eliminate products of combustion and to return the fastener driver to its normal, unactuated position.

BACKGROUND ART

The majority of fastener driving tools in use today are pneumatically actuated tools. Pneumatic fastener driving tools have been developed to a high degree of sophistication and efficiency, but require a source of air under pressure and are literally tied thereto by hose means. Under some circumstances, particularly in the field, a source of air under pressure is not normally present and is expensive and sometimes difficult to provide.

Prior art workers have also developed a number of electro-mechanical fastener driving tools, usually incorporating one or more flywheels with one or more electric motors therefor. Such tools require a source of electrical current normally present at the job site. As a result, this type of tool is also quite literally "tied" to a power source.

Under certain circumstances, it is desirable to utilize a completely self-contained fastener driving tool, not requiring a source of air under pressure or a source of electrical current. To this end, prior art workers have devised self-contained fastener driving tools powered by internal combustion of a gaseous fuel-air mixture. It is to this type of tool that the present invention is directed.

Exemplary prior art internal combustion fastener driving tools are taught, for example, in U.S. Pat. Nos. 2,898,893; 3,042,008; 3,213,607; 3,850,359; 4,075,850; 4,200,213; 4,218,888; 4,403,722; 4,415,110; and European Patent Application Nos. 0 056 989; and 0 056 990. While such tools function well, they are usually large, complex, heavy and awkward to use.

The fastener driving tool of the present invention comprises a self-contained internal combustion tool which is compact, easy to manipulate and simple in construction. The fastener driving tool is highly efficient, operating on a high compression ratio to convert most of the fuel energy into useful work. The tool utilizes a pair of coaxial upper and lower cylinders. The upper cylinder has a piston assembly and, during a tool cycle, serves as a compressor to replenish air under pressure in a combustion air chamber to which the upper cylinder is connected by a one-way valve. The lower cylinder is provided with a piston/driver which, during a tool cycle, drives a fastener into a workpiece and fills a return air chamber (to which the lower cylinder is connected) with air under pressure. The upper cylinder piston assembly and the lower cylinder piston/driver assembly, when in their normal positions, define a combustion chamber provided with an ignition means.

The fastener driving tool is provided with a positive, trigger-actuated cam system which sequences the tool through its cycle, upon actuation of the trigger. The cam system operates a series of two-way valves and an ignition device.

DISCLOSURE OF THE INVENTION

According to the invention there is provided a fastener driving tool which is self-contained and uses internal combustion of an air gaseous fuel mixture as its driving force. The tool comprises a tool housing or body, including a handle portion. A guide body is mounted at the lower end of the housing. A magazine, containing a plurality of fasteners, is supported at one end by the guide body and at its other end by the handle portion.

The tool body contains upper and lower coaxial cylinders which are open at their adjacent ends. The upper cylinder is connected to a combustion air chamber by one-way valve means. The upper cylinder and its piston assembly serve as a compressor during the tool cycle to replenish air under pressure in the combustion air chamber. The lower cylinder is surrounded and connected to a return air chamber. The lower cylinder contains a piston/driver assembly for driving a fastener during the tool cycle. The upper cylinder piston assembly and the lower cylinder piston/driver assembly, when in their normal unactuated positions, define therebetween a combustion chamber provided with an ignition device.

The tool cycle is controlled by a positive, trigger-actuated cam system. Upon actuation of the trigger, the cam system is configured to first open a fuel valve to introduce a measured amount of gaseous fuel from a source thereof into the combustion chamber. Thereafter, the cam system opens an air valve to introduce a measured quantity of air from the combustion air chamber into the combustion chamber. The cam system next actuates the ignition device to combust the air/fuel mixture. This combustion causes the lower cylinder piston/driver assembly to drive a fastener and to fill the return air chamber with air under pressure. Simultaneously, this combustion causes the upper cylinder piston assembly to replenish air under pressure in the combustion air chamber. Finally, the cam system is configured to actuate a control or pilot valve which admits some of the air under pressure from the return chamber to an exhaust valve, opening the exhaust valve to eliminate the spent products of combustion from the combustion chamber. This, in turn, enables the piston assembly of the upper cylinder to return to its normal position under the influence of spring. It also permits the lower cylinder piston/driver assembly to be shifted to its normal position by air under pressure from the air return chamber. Thereafter, the tool is ready for its next actuation and driving cycle. As will be pointed out hereinafter, the same sequence control can be achieved through the use of a single trigger-actuated cam, rather than a system of cams

BRIEF DESCRIPTION OF THE DRAWINGS

FIG. 8 is a fragmentary, cross-sectional, plan view taken along 8—8 of FIG. 1.

FIG. 9 is a fragmentary, cross-sectional view taken along section 9—9 of FIG. 1, with the link also shown in cross section.

FIG. 10 is a cross-sectional view taken along section line 10—10 of FIG. 3.

DETAILED DESCRIPTION OF THE INVENTION

In all of the Figures, like parts have been given like index numerals. Reference is first made to FIGS. 1-4. In these figures, the tool of the present invention is generally indicated at 1. The tool 1 comprises a main housing 2 having a handle 3. A guide body 4 is affixed to the lower end of the main housing. A magazine for fasteners is illustrated at 5, being affixed at its forward end to the guide body and at its rearward end to the handle 3.

Figure 4:
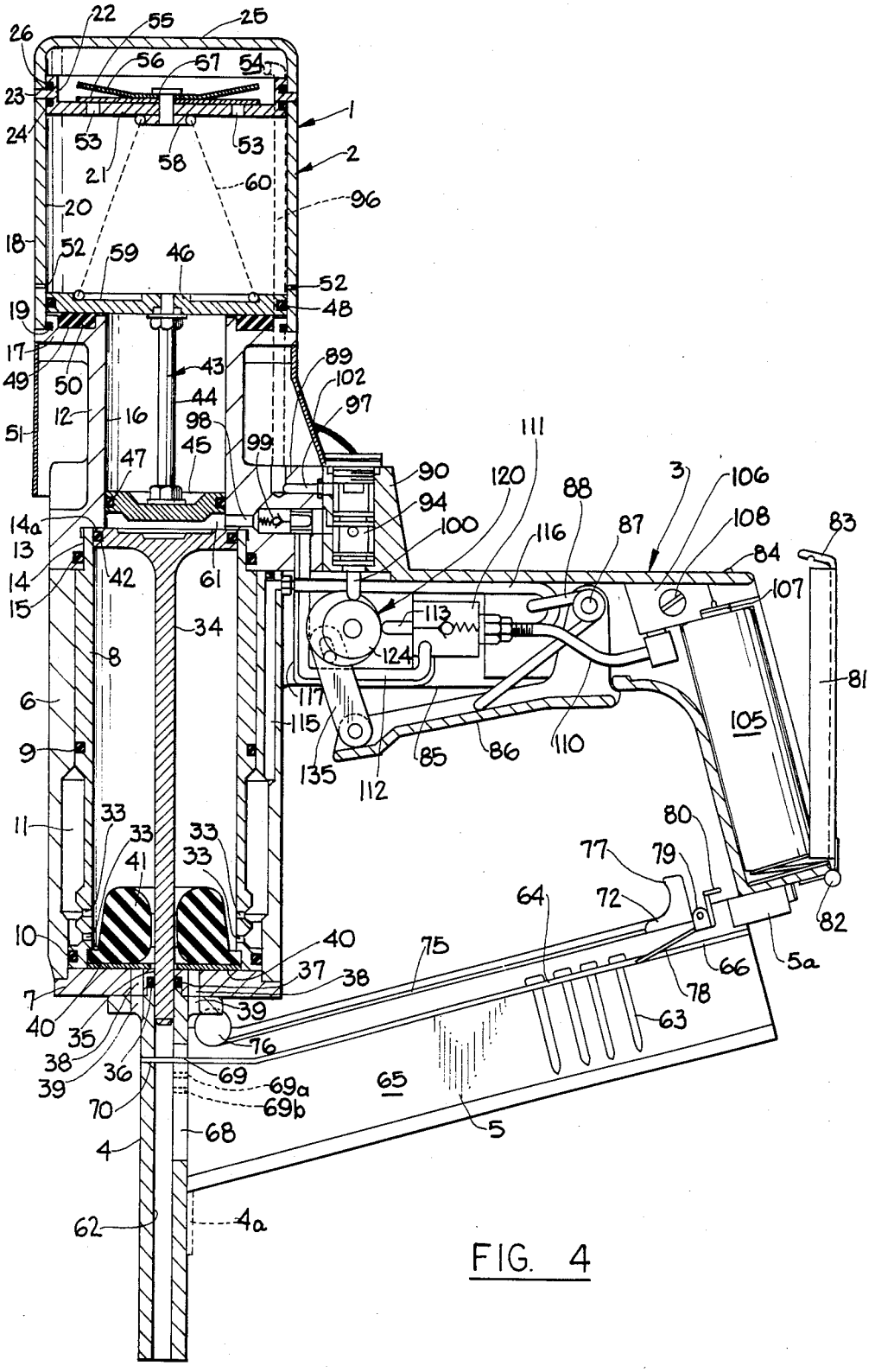
FIG. 4 is a cross-sectional view taken along section line 4—4 of FIG. 3.

Turning to FIG. 4, the lower part of housing 2 comprises a first cylindrical member 6. The lower end of cylindrical member 6 is closed by a bottom cap 7, removably affixed thereto by any suitable means such as bolts or the like (not shown). The cylindrical housing member 6 contains a lower cylinder 8. The lower cylinder 8 carries on its exterior surface O-rings 9 and 10 forming a fluid tight seal with the inside surface of cylindrical housing member 6. The inside surface of the cylindrical housing member 6 and the exterior surface of lower cylinder 8 are so configured as to form an annular return air chamber 11 therebetween, the purpose of which will be apparent hereinafter.

The cylindrical housing member 6 is surmounted by a second housing member 12. The second housing member 12 has a lower flange 13 by which it is affixed to the upper end of first housing member 6 by bolts or the like (not shown). Housing member 12 has a central bore, coaxial with the central bore of lower cylinder 8. The bore of housing member 12 has a first portion 14 adapted to just nicely receive the reduced diameter upper end of lower cylinder 8, and a shoulder portion 14*a*. The housing member 12 carries an O-ring 15 making a fluid tight seal with the upper end of lower cylinder 8. The remainder of the bore of housing member 12 is of lesser diameter, and is indicated at 16. Housing member 12 terminates in a peripheral flange portion 17 adapted to receive and support a third housing member 18. The flange 17 of housing member 12 carries an O-ring 19 making a fluid tight seal with the lower inside surface of housing member 18. Housing member 18 has a cylindrical bore 20 coaxial with the bore of lower cylinder 8 and the bores 14 and 16 of housing member 12. Bores 16 and 20 constitute the upper cylinder of the tool.

The upper end of housing member 18 supports a plate 21. Plate 21 has an upstanding annular flange 22. An annular rim 23 is located on the exterior surface of annular flange 22. The rim 23 is so sized as to rest upon the upper end of housing member 18. That portion of the flange 22 of plate 21 located below rim 23 carries an O-ring 24 making a fluid tight seal with the upper inside surface of bore 20 of housing member 18.

A fourth housing member, in the form of an upper housing cap 25, rests upon the rim 23 of plate 21. That portion of plate flange 22 extending above plate rim 23 carries an O-ring 26 making a fluid tight seal with the inside surface of upper cap 25.

Figure 1:
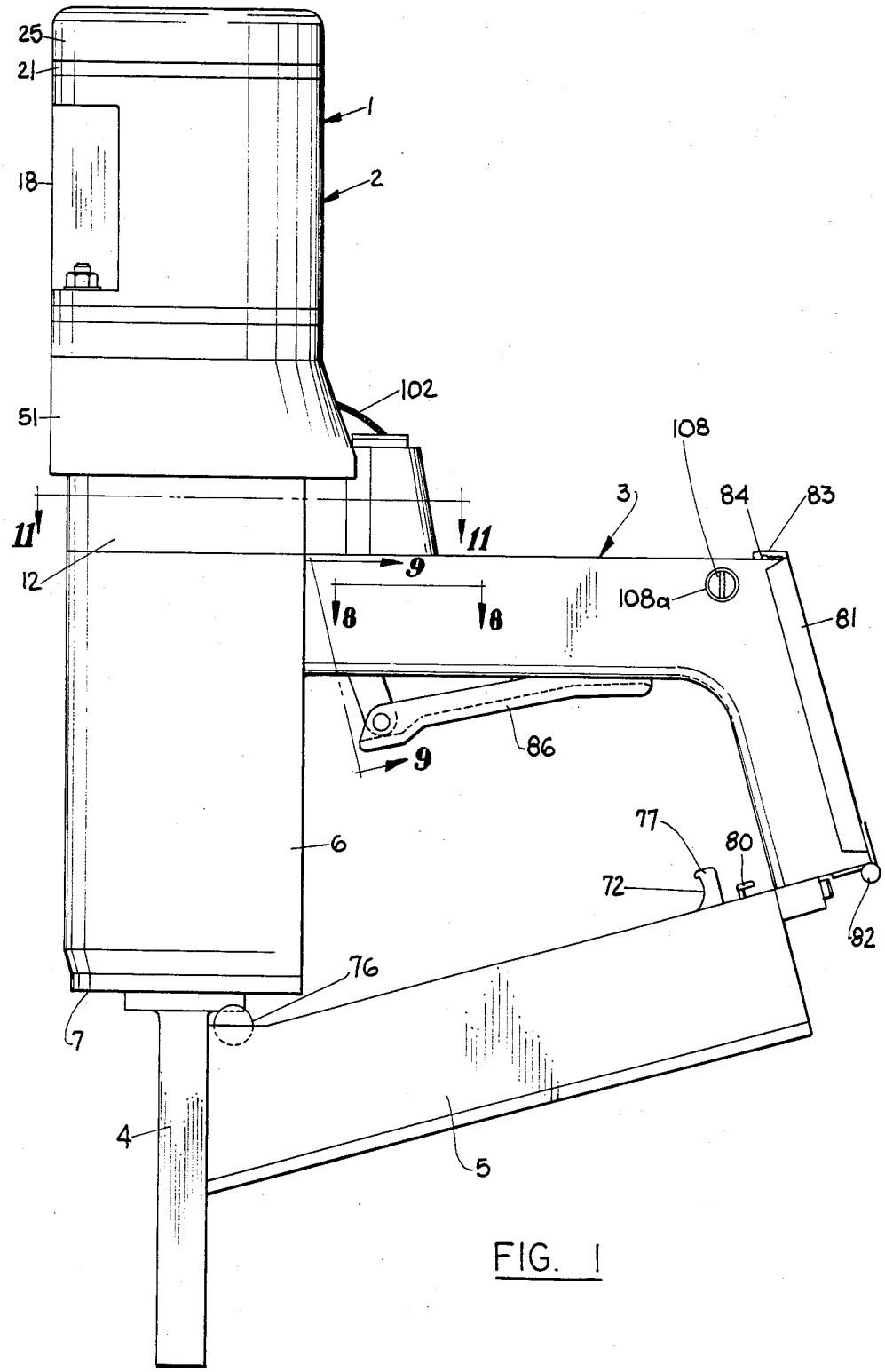
FIG. 1 is a side elevational view of the self-contained internal combustion fastener driving tool of the present invention.
Figure 2:
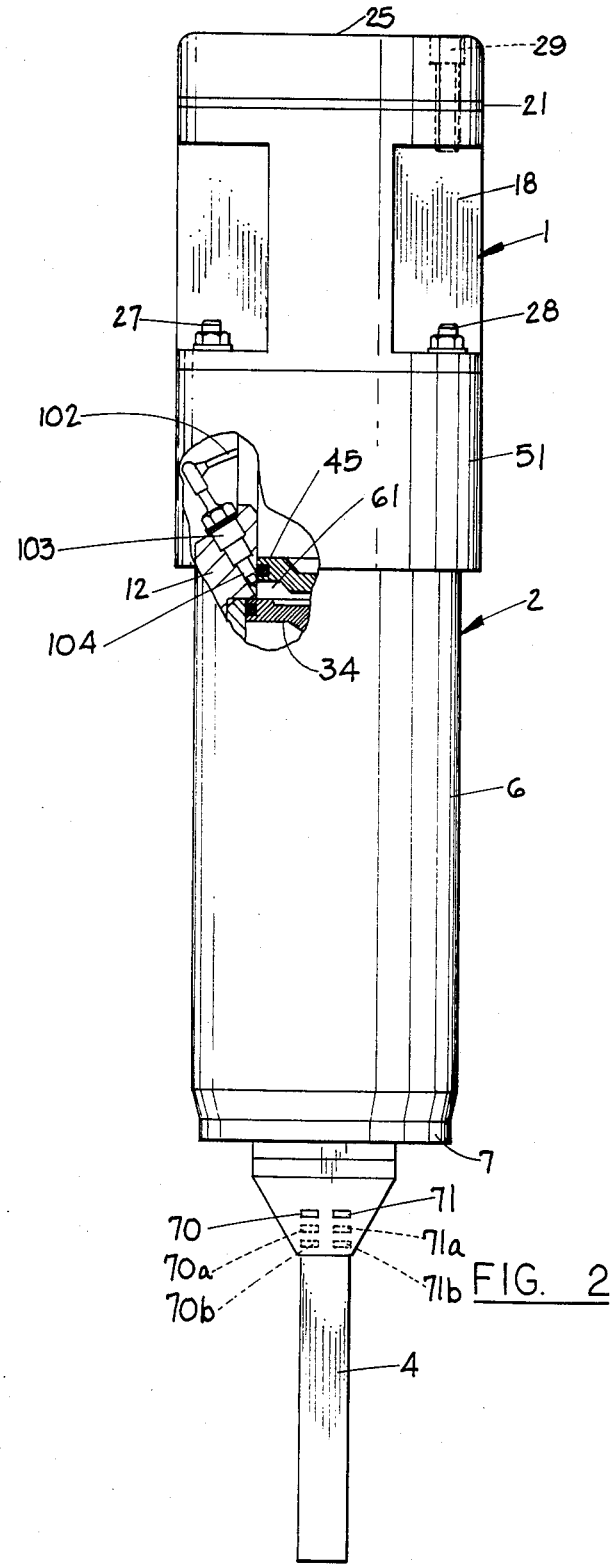
FIG. 2 is a front elevational view of the tool of FIG. 1, partly in cross section to reveal the spark plug for the combustion chamber.
Figure 3:
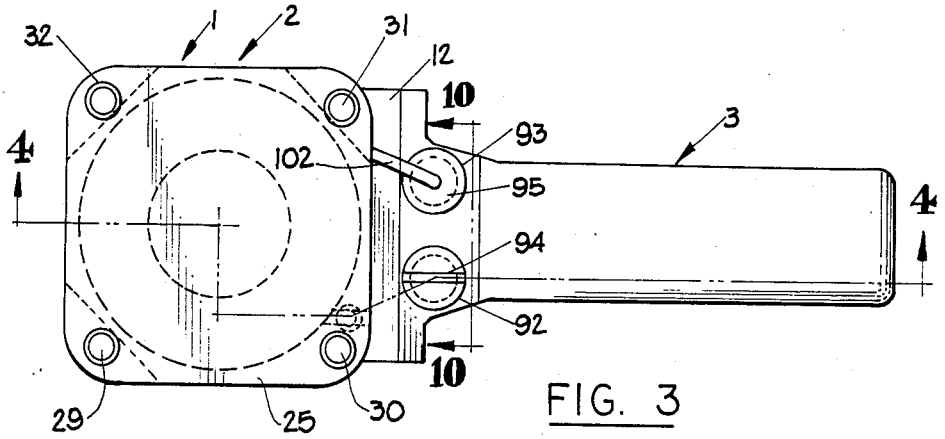
FIG. 3 is a plan view of the tool of FIG. 1.

Housing member 18 is affixed to the upper flange 17 of housing member 12 by a plurality of bolts, two of which are shown at 27 and 28 in FIG. 2. In similar fashion, the upper cap 25 is affixed to housing member 18 by a plurality of bolts 29-32 (see FIGS. 2 and 3).

Lower cylinder 8 has a plurality of radial perforations 33 communicating with return air chamber 11. The lower cylinder 8 contains a piston/driver assembly 34. Bottom plate 7 has a bore 35 adapted to receive the lower end of the piston/driver assembly 34. It will be noted that the bore 35 is enlarged as at 36 to receive the end of guide body 4. An O-ring 37 is located between the bottom plate 7 and the upper end of guide body 4, and also makes a fluid tight seal with the lower end of piston/driver assembly 34. Bottom plate 7 is provided with a plurality of bores 38 about the piston/driver bore 35. Guide body 4 is provided with a series of bores 39. The bores 39 are coaxial with the bores 38, which are normally closed by rubber flapper valves 40. It will be understood that guide body 4 and bottom plate 7 could constitue an integral one-piece structure. The bottom of lower cylinder 8 is provided with a resilient bumper 41 adapted to absorb the energy of the piston/driver assembly at the bottom of its stroke. It will be noted that the upper end of the piston/driver assembly 34 supports an O-ring 42 making a fluid tight seal with the inside surface of lower cylinder 8. In FIG. 4, the piston/driver assembly 34 is shown in its uppermost position, abutting the shoulder 14*a* of housing member 12.

An upper cylinder piston assembly is generally indicated at 43. Piston assembly 43 comprises a piston rod 44 having a smaller piston 45 affixed to its lower end and a larger piston 46 affixed to its upper end. The smaller piston 45 carries an O-ring 47 making a fluid tight seal with the inside surface of bore 16 of housing member 12. The upper piston 46 carries an O-ring 48 making a fluid tight seal with the inside surface of the bore 20 of housing member 18. The upper end of housing member 12 has an annular notch 49 adapted to receive an annular resilient member 50, serving as a bumper for the bottom surface of piston 46. The housing member 12 is also provided with a downwardly depending skirt 51 constituting an exhaust deflector shield, as will be more fully understood hereinafter.

The housing member 18 is provided with a plurality of perforations 52. The perforations 52 are located just above upper piston 46 when in its normal position as shown in FIG. 4. The perforations 52 serve as air vents, as will be apparent hereinafter.

The plate 21 is also provided with a pair of perforations 53 leading to that portion of the housing defined by plate 21 and upper cap 25 and constituting a combustion air chamber 54. The perforations 53 are provided with a flapper valve 55, the amount by which flapper valve 55 opens is governed by back-up plate 56. The back-up plate 56 and flapper valve 55 are affixed to plate 21 by bolt 57 and nut 58.

It will be noted that the uppermost piston 46 of the piston assembly 43 is provided with an annular depression 59. The annular depression 59 serves as a seat for the bottom end of conical spring 60. The upper end of conical spring 60 abuts plate 21 and surrounds nut 58. Spring 60 biases the upper piston assembly 43 to its normal position illustrated in FIG. 4.

When the upper piston assembly 43 is in its normal position as shown in FIG. 4, and when the piston/driver assembly 34 is in its normal position as shown in FIG. 4, the piston portion of piston/driver assembly 34 and the lower piston 45 of assembly 43 define between them a combustion chamber 61.

The guide body 4 has a longitudinal slot or bore 62 constituting a drive track for the driver portion of the piston/driver assembly 34. As indicated above, the tool of the present invention may be used to drive any appropriate type of fastening means including studs, nails, staples and the like. For purposes of an exemplary showing, the tool is illustrated in an embodiment suitable for driving studs. It will be understood that the configuration of the driver portion of piston/driver assembly 34, the configuration of drive track 62 and the nature of magazine 5 can vary, depending upon the type of fastener to be driven by the tool 1.

Figure 5:
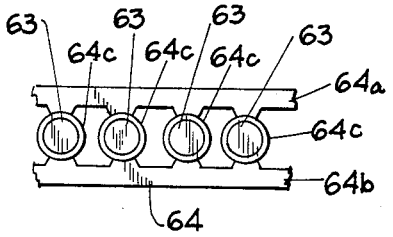
FIG. 5 is a fragmentary plan view of an exemplary strip of fasteners such as nails or studs.
Figure 6:
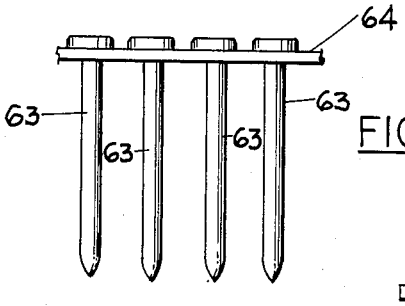
FIG. 6 is a fragmentary elevational view of the strip of fasteners of FIG. 5.

Reference is now made to FIGS. 5 and 6. The exemplary fasteners are illustrated in FIGS. 5 and 6 as headed studs 63. The studs are supported by an elongated plastic strip 64. As can best be ascertained from FIG. 5, the plastic strip 64 is an integral, one-piece structure comprising two elongated ribbon-like members 64*a* and 64*b* joined together by a plurality of circular washer-like members 64*c*. The washer-like members 64*c* have central perforations sized to receive the shanks of studs 63 snugly. When each stud is driven, in its turn, by the driver portion of piston/driver assembly 34, its respective washer-like structure 64*c* will break away from ribbon-like members 64*a* and 64*b* and will remain with the stud.

Figure 7:
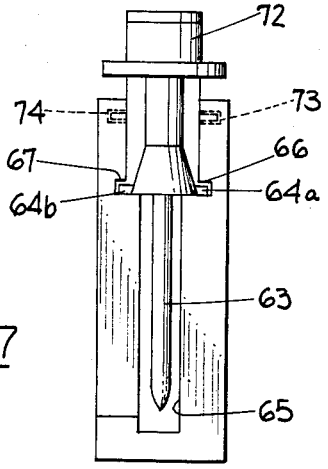
FIG. 7 is a rear elevational view of the tool magazine.

Reference is now made to FIGS. 4 and 7. The magazine 5 has a central opening 65 extending longitueinally thereof and accommodating the studs 63. The opening 65 is flanked on each side by shallow transverse slots 66 and 67, also extending longitudinally of magazine 5. The ribbon-like portions 64*a* and 64*b* of the strip 64 are slidably received in the slots 66 and 67, respectively. The rearward wall of the guide body 4 has a slot 68 formed therein corresponding to the opening 65 of magazine 5. The guide body slot 68 is intersected by a pair of transverse slots, one of which is shown at 69. These slots correspond to magazine slots 66 and 67, and similarly cooperate with the ribbon-like portions 64*a* and 64*b* of strip 64. The forward wall of guide body 4 has a pair of transverse slots 70 and 71 formed therein (see also FIG. 2). The slots 70 and 71 are larger in size than ribbon-like strip portions 64*a* and 64*b* and permit scrap portions of strip elements 64*a* and 64*b*, from which the studs 63 and washer-like elements 64*c* have been removed, to exit the tool.

From the above description it will be apparent that the studs 63 are supported by strip 64, and that the strip 64, itself, is slidably supported within magazine 5. With the studs depending downwardly in opening 65 and strip portions 64*a* and 64*b* slidably engaged in magazine slots 66 and 67, the guide body rear wall slots (one of which is shown at 69) and the guide body front wall slots 70 and 71. The forwardmost stud 63 of the strip enters the drive track 62 of guide body 4 via slot 68 and is properly located under the driver portion of piston/-driver assembly 34 by its respective washer 64*c*. Once the stud and washer assembly has been driven by the driver portion of piston/driver assembly 34, the strip will advance in the magazine and guide body to locate the next forwardmost stud 63 in guide body drive track 62, as soon as the piston/driver assembly 34 has returned to its normal position shown in FIG. 4.

Any appropriate means can be employed to advance the strip 64 through magazine 5 and to constantly urge the forwardmost stud 63 of the strip into the guide body drive track 62. For purposes of an exemplary showing, a feeder shoe 72 is illustrated in FIGS. 4 and 7. The feeder shoe 72 is slidably mounted in transverse slots 73 and 74 in the magazine (see FIG. 7). The feeder shoe 72 is operatively attached to a ribbon-like spring 75 located in an appropriate socket 76 at the forward end of magazine 5. In this way, the feeder shoe 72 is constantly urged forwardly in the magazine 5, and as a result, constantly urges the stud supporting strip 64 forwardly. The feeder shoe 72 has a handle portion 77 by which it may be easily manually retracted during the magazine loading operation. A lug 78 is also mounted on the feeder shoe 72. A spring (not shown) is mounted about pivot pin 79 with one leg of the spring abutting feeder shoe 72, and the other leg abutting the lug 78 to maintain the lug 78 in its downward position as shown in FIG. 4. In its downward position, the lug 78 abuts the rearward end of strip 64, enabling the feeder shoe (under the influence of spring 75) to urge the strip 64 forwardly. The lug 78 has an integral, upstanding handle 80 by which it can be pivoted upwardly toward the feeder shoe 72, and out of the way during loading of the magazine 5.

The handle 3 of tool 1 is hollow. At its rearward end, the handle 3 is provided with a closure or door 81. The door 81 is hinged as at 82. The upper end of the door is provided with a notched tine 83 which cooperates with a small lug 84 on the upper surface of the handle 3, to maintain the door 81 in closed position.

The lower part of the grip portion of handle 3 is open, as at 85. This opening provides room for a manual trigger 86 which is pivotally mounted within handle 3, by pivot pin 87. The trigger 86 normally rests in its downward or most extended condition, as shown in FIG. 4, by virtue of a biasing spring 88. The second housing member 12 has a rearward extension 89. The upper part of the forward end of handle 3 has a mating extension 90. The forward end of the handle 3 is affixed to housing 2 by a series of bolts, two of which are shown at 91 in FIG. 11.

The handle extension portion 90 contains a pair of bores 92 and 93. The bore 92 houses a two-way air valve 94. The bore 93 houses a conventional piezoelectric device 95.

Figure 11:
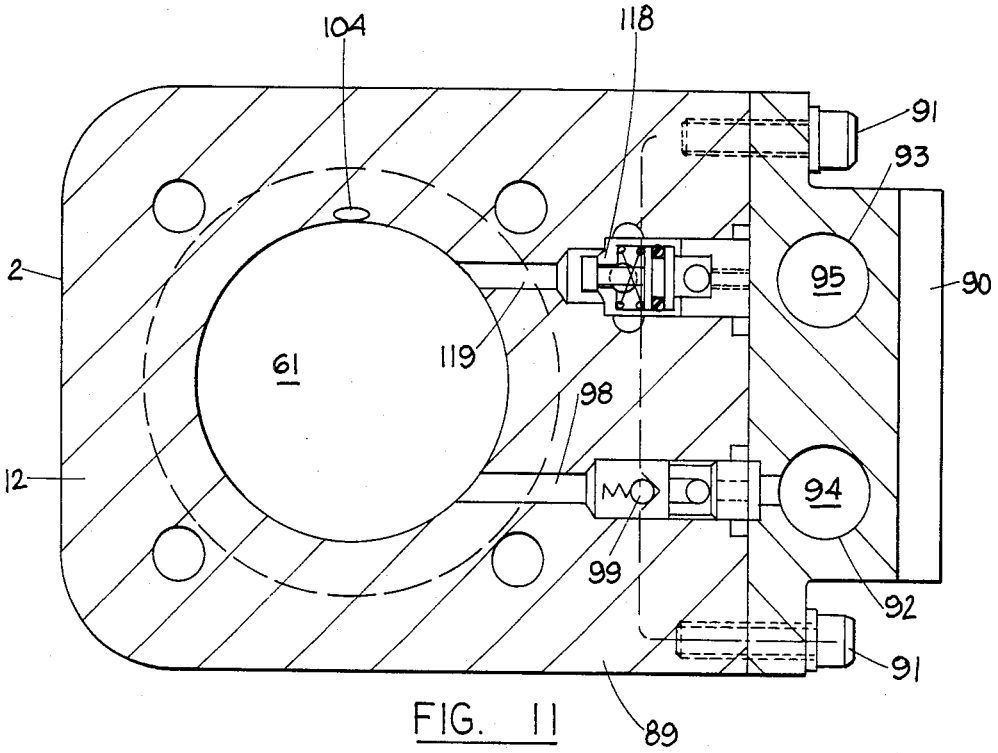
FIG. 11 is a cross-sectional view taken along section line 11—11 of FIG. 1.

Referring to FIGS. 4, 10 and 11, bore 92 containing valve 94 is connected to the combustion air chamber 54 by passages 96 and 97. This is most clearly shown in FIG. 4. As is most clearly shown in FIG. 11, bore 92 is also connected to combustion chamber 61 through passage 98 in body portion 89 and handle portion 90. The passage 98 includes a one-way valve 99. Two-way air valve 94 is provided with an actuator 100, which will be further described hereinafter.

The piezoelectric device 95 has a similar actuator 101, about which more will be stated hereafter. The piezoelectric device 95 is connected by wire means 102 to a spark plug 103, mounted in a bore 104 in body member 12, which bore is connected to combustion chamber 61 (see FIG. 2).

Reference is now made to FIGS. 4 and 8. The rearward end of handle 3 is provided with the door 81 to enable the placement within the handle of a canister 105, containing a gaseous or liquifiedfuel. The canister 105 is adapted to mate with a pressure regulating needle valve 106 located within handle 3. This mating of canister 105 with needle valve 106 opens a spring loaded valve 107, constituting a part of canister 105. Needle valve 106 has an adjustment screw 108, accessible through a perforation 108 in handle 3. The pressure regulating needle valve 106 is connected by a conduit 110 to a two-way valve 111, mounted within handle 3. The outlet of valve 111 is connected by conduit 112 to the passage 98 (see FIG. 4) ahead of one-way check valve 99. The two-way gaseous fuel valve 111 is provided with an actuator 113, similar to the actuators 100 and 101 of air valve 94 and piezoelectric device 95.

As can best be seen in FIG. 8, a two-way pilot valve 114 is located within handle 3, along side gaseous fuel valve 111. Pilot valve 114 is connected to return air chamber 11 by means of the passage 115 formed in housing member 6 and conduit 116 (see also FIG. 4). The output of pilot valve 114 is connected by a conduit or passage 117 (see FIG. 4) to a normally closed, two-way, air-actuated exhaust valve 118 (see FIG. 11). It will be noted from FIG. 11 that exhaust valve 118 is located alongside one-way check valve 99 in the extended portion 89 of housing member 12. The input of exhaust valve 118 is connected by a passage 119 in housing member 12 to the combustion chamber 61. The output of exhaust valve 118 is connected by a passage (not shown) in housing member 12 to atmosphere. The port for this last mentioned passage is located behind exhaust shield 51.

To complete the structure of tool 1, a trigger actuated control cam system is provided and is generally indicated at 120 in FIGS. 4 and 9.

As is best seen in FIG. 9, the cam system 120 is made up of two parts **120*a* and 120*b*. The part 120*a* comprises a shaft portion 121 rotatively mounted in a perforation 122 in handle 3. The shaft portion 121 is followed by a spacer portion 123 and two cam elements 124 and 125. The elements 124 and 125 are followed by another spacer member 126 having an offset shaft portion 127. The cam system portion 120*b*, in similar fashion has a shaft portion 128 rotatively mounted in a perforation 129 in handle 3. The shaft portion 128 is followed by a spacer portion 130, a pair of cam elements 131 and 132 and a second spacer portion 133 having a pin portion 134**.

When the cam system 120 is assembled, its pin portions 127 and 128 are located in a perforation 134 in a link 135. Pin portions 127 and 134 abut each other and engage each other such that they will not rotate relative to each other. When assembled, pin portions 121 and 128 of cam system 120 are coaxial. Similarly, shaft portions 127 and 134 are coaxial. The axes of these two shaft and pin sets 121–128 and 127–134 are parallel and spaced from each other. The cam system 120 could be made as an integral, one-piece part. Under these circumstances, the link would be made up of more than one piece so that it could be connected to the cam system 120.

The top end of link 135 being pivotally attached to cam system 120, the bottom end of link 135 is similarly pivotally attached to trigger 86. To this end, a pivot pin 136 passes through perforations 137 and 138 in trigger 86 and a perforation 139 at the bottom end of link 135. It will be immediately apparent from FIGS. 4, 8 and 9 that if trigger 86 is depressed against the action of trigger biasing spring 88, and then is released, the trigger link 135 will cause one complete revolution of cam system 120.

As will be apparent from FIG. 8, the plunger-like actuator 113 of gaseous fuel valve 111 contacts and is operated by cam element 125. Similarly, plunger-like actuator **114*a* of pilot valve 114 contacts and is operated by cam element 132. As is shown in FIG. 4, plunger-like actuator 100 of air valve 94 contacts and is operated by cam element 124. In a similar fashion, as can be ascertained from a comparison of FIGS. 8 and 10, the plunger-like actuator 101 of piezoelectric device 95 contacts and is operated by cam element 131. It will be understood that cam elements 124, 125, 131 and 132 are so configured as to operate their respective plunger-like actuator 100, 113, 101 and 114*a* in the proper sequence. It will further be apparent that trigger 86** must be fully depressed and fully released to cause the tool to operate through one complete cycle.

TOOL OPERATION

The tool 1 of the present invention having been described in detail, its operation can now be set forth as follows. Reference is made to FIG. 4, wherein the tool and its various elements are shown in their normal, unactuated conditions.

For its initial use, or if the tool has not been used for some time, air pressure in combustion air chamber 54 and return air chamber 11 will be at atmospheric level. Under these circumstances, before a fastener strip is loaded into the magazine, the handle door 81 is opened and a gaseous fuel canister is located in the handle and is appropriately connected to needle valve 106. The needle valve 106 is set to an intermediate position by needle valve control screw 108. The tool is then ready to be primed with fresh air. This can be done in several ways. Priming can be accomplished through a hand air pump which can readily bring the system to operating condition. Another way to prime the tool involves inserting a rod into drive track 62 and attaching it to the piston/driver assembly 34 (by a threaded engagement or other appropriate means) and moving the piston/-driver assembly up and down several times manually. A third possible approach is to actuate the tool through the trigger several times, with the needle valve 106 set at an intermediate position, thereby creating gradually increasing combustion energy so that the air chambers are primed with compressed air at the operating level.

Once the tool is primed and in operating condition, the feeder shoe 72 is grasped by its handle portion 77 and pulled rearwardly with respect to magazine 5. The lug 78 is shifted out of the way by means of its handle portion 80 and a strip 64 carrying a plurality of studs 63 is loaded into the magazine with the forwardmost stud being located in the drive track 62 of guide body 4. The lug 78 and feeder shoe 72 are then released.

The needle valve 106 is properly adjusted by means of adjustment screw 108, if required.

When it is desired to actuate tool 1, the guide body is located against the workpiece at a position where it is desired to drive a stud, and the manual trigger 86 is actuated by the operator. As a result of the trigger actuation, a tool cycle is initiated, including the following sequential events.

Actuating manual trigger 86 results, through the action of the trigger 86 and link 135, in rotation of the cam system 120. Cam elements 124, 125, 131 and 132 are so configured that cam element 125 first operates the actuator 113 of two-way fuel valve 111 introducing a metered amount of gaseous fuel into combustion chamber 61 through check valve 99. The amount of fuel introduced depends upon the setting of regulator 108 of needle valve 106. The piston/driver assembly 34 shifts slightly downwardly due to the pressure of the gaseous fuel within combustion chamber 61. When the cooperation of cam element 125 and actuator 113 begins to close fuel valve 111, the next operation of the cycle is initiated.

Continued rotation of the cam system 120 initiates the second operation of the cycle wherein cam element 124 operates actuator 100 of air valve 92, introducing combustion air from combustion air chamber 54 into the combustion chamber 61 through one-way valve 99. The piston/driver assembly 34, at this point, is pressed against the head of the forwardmost stud located in guide body drive track 62. The strip 64, supporting studs 63, is designed to be strong enough to withstand the loading due to the pressure of the air/fuel mixture over the piston/driver assembly 34. At the same time, the piston assembly 43 of upper cylinders 16–20 moves upwardly due to the increase in pressure in the combustion chamber 61, and is balanced by the spring 60 and air pressure above piston 46. Due to vent 52, the air pressure between pistons 45, and 46 remains at atmosheric. As a result of this operation, the proper mixture of air and fuel is present in combustion chamber 61. The air/fuel mixture is under high compression ratio (for example 4:1 and preferably about 6:1 or more) assuring the most complete burning and the most efficient use of the fuel. As the cam system 120 continues to rotate and the interaction of cam element 124 and actuator 100 begins to close air valve 94, the next operation is initiated.

The third operation of the cycle involves operation of actuator 101 of piezoelectric device 95 by cam element 131. When the crystal of the piezoelectric device 95 is struck or fully compressed, a spark of high voltage is generated between the electrodes of spark plug 103 in combustion chamber 61. As a result, the fuel/air mixture ignites, generating a rapid expansion of the combusted gases which increases the pressure on both piston/driver assembly 34 and piston assembly 43. At this point, manual trigger 86 is completly actuated or depressed.

The piston/driver assembly 34 shifts downwardly as viewed in FIG. 4, shearing the washer **64*c* (surrounding the forwardmost stud of the strip) from strip 64 and driving the forwardmost stud into the workpiece (not shown). While the piston/driver assembly 34 shifts downwardly, air beneath the piston/driver assembly is compressed into return air chamber 11 through ports 33. That energy of piston/driver assembly 34 not expended in driving the stud is absorbed by the resilient bumper 41. Simultaneously, piston assembly 43 shifts upwardly. As soon as upper piston 46 passes ports 52 in housing member 18, air trapped within cylinder portion 20 is compressed into combustion air chamber 54 via ports 53 and flapper valve 55, replenishing the combustion air in chamber 54. When the pressure over and under flapper valve 55 is balanced, the flapper valve closes ports 53 trapping compressed air within combustion air chamber 54**.

The above described three operations of the tool cycle completes the drive part of the cycle. The return part of the cycle begins as manual trigger 86 begins to return toward its normal, unactuated position, under the influence of spring 88.

At this point, the fourth operation of the cycle begins. The fourth operation of the cycle entails operation of actuator **114*a* of pilot valve 114 by cam element 132, as the cam system 120 continues its rotation. When two-way pilot valve 114 is opened, a part of the air under pressure from return air chamber 11 is used to actuate or open exhaust valve 118. This enables the products of combustion from combustion chamber 61 to be exhausted to atmosphere. With the combustion chamber being exhausted, the remainder of the return air from return air chamber 11 is channeled beneath the piston/driver assembly 34 through ports 33, returning the piston/driver assembly 34 to its normal or prefire position. Flapper valves 40 beneath resilient bumper 41 open to permit fresh air to enter beneath the piston/driver assembly until it is balanced to atmospheric level. At the same time, when the combustion air chamber 61 is exhausted, the piston assembly 43 shifts downwardly to its normal or prefire position by action of conical spring 60. By virtue of ports 52 in body portion 18, the air contained between upper piston 46 and lower piston 45 of piston assembly 53 within cylinder portion 16 is maintained at atmospheric level. Air within cylinder portion 20 is replenished at atmospheric level by means of ports 52, once the piston assembly 43** has returned to its normal, prefire position.

Manual trigger 86 returns to its normal, unactuated position. Feeder shoe 72 and its lug 78 assure that the next forwardmost stud 63 of strip 64 is located within drive track 62 of guide body 4 as soon as piston/driver assembly 34 returns to its normal retracted position. As a result, the tool cycle is complete and the tool is ready for another cycle.

Figure 12:
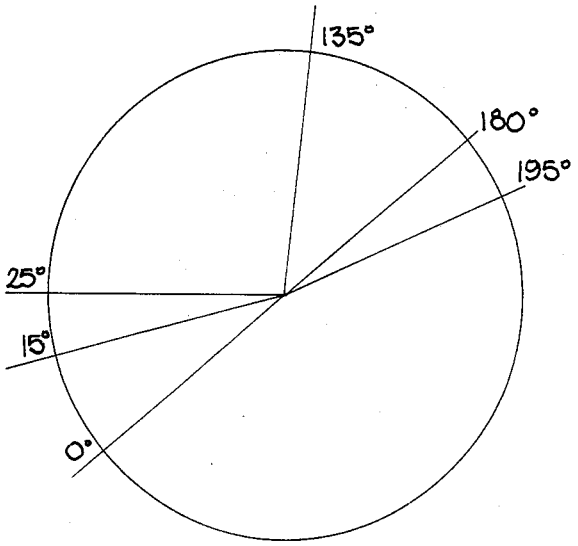
FIG. 12 is a diagrammatic representation of the cam system operating positions.

FIG. 12 is a diagrammatic representation of the various operation initiation points of cam system 120. At the 0° mark the manual trigger 86 is at rest in its normal position. When the operator actuates trigger 86, causing rotation of cam system 120, cam element 125 will operate the actuator 113 of two-way fuel valve 111 after about 15° of rotation of cam system 120. At about 25° of rotation, cam element 124 will operate actuator 100 of two-way air valve 94. At about 135° of rotation, cam element 131 will operate actuator 101 of piezoelectric device 95. At 180° the trigger is fully depressed.

When the trigger is released and begins to return to its normal, unactuated condition under the influence of spring 88, cam element 132 will operate actuator **114*a* of pilot valve 114 when the cam system 120 has rotated about 195°. Thereafter, the cam system 120 will return to its normal, unactuated position indicated at 0°. It will be apparent to one skilled in the art that by properly arranging two-way fuel valve 111**, two-way air valve 94, piezoelectric device 95 and two-way pilot valve 114 thereabout, a single cam element could be substituted for cam elements 124, 125, 131 and 132. The single cam element could be rotatively mounted in the handle 3 and caused to rotate 360° by a manual trigger and lever similar to trigger 86 and lever 135. The single cam element would operate each of actuators 113, 100, 101 and 114*a*.

The tool 1 could be provided with various types of safety devices, as is well known in the art. For example, manual trigger 86 could be disabled until a workpiece responsive trip (not shown), operatively connected thereto, is pressed against the workpiece to be nailed. A workpiece responsive trip may be used to close a normally open switch in the line connecting the spark plug and the piezoelectric device. Such arrangements are well known in the art and do not constitute a part of the present invention.

It will be understood that the tool of the present invention may be held in any orientation during use and still operate. Thus, words such as "upper", "lower", "upwardly", "downwardly", "vertical", and the like are used in the above description and the claims in conjunction with the drawings for purposes of clarity, and are not intended to be limiting.

Modifications may be made in the invention without departing from the spirit of it. For example, the power output of the tool 1 of the present invention can be varied, by changing the size of combustion chamber 61. It will be remembered that, when fuel and combustion air are introduced into the combustion chamber 61 during the tool cycle, the piston/driver asembly 34 shifts slightly downwardly until the free end of the driver contacts the head of the forwardmost stud in drive track 2 of guide body 4. Thus, the size of combustion chamber 61 is dietermined, in part, by the position of the piston portion of piston/driver asesmbly 34. As a consequence, if the forwardmost stud 63 located in drive track 62 of guide body 4 were slightly lowered, the piston portion of piston/driver assembly 34 would lower an equivalent amount, enlarging combustion chamber 61 and increasing the amount of air/fuel mixture it can contain. In this way, the power of the tool would be increased. Lowering the fowardmost stud in the drive track 62 of guide body 4 can be accomplished in several ways. First of all, a different guide body and magazine could be substituted, if a power increase is desired. Another way would be to lower the entire magazine 5 with respect to the remainder of tool 1. This could be accomplished by making the attachment of the forward end of magazine 5 to guide body 4 an adjustable one. For example, the forward end of magazine 5 could ride in a pair of tracks (one of which is shown in broken lines at 4*a* in FIG. 4). Preferably, means (not shown) are provided to lock the forward end of magazine 5 in selected adjusted positions with respect to the tracks. To this end, the opening 68 in the rearward wall of guide body 4 could be so sized as to enable the passage of studs therethrough in any of the preselected positions of magazine 5. Similarly, additional slots equivalent to slot 69 should be provided at selected positions in the guide body, such additional slots are shown in FIG. 4 in broken lines at 69*a* and 69*b*. Additional slots equivalent to slots 70 and 71 should be provided in the forward wall of guide body 4. Such additional slots are indicated in broken lines in FIG. 2 at 70*a*–71*a* and 70*b*–71*b*. Finally, the bracket means 5*a* (see FIG. 4) by which the rearward end of magazine 5 is attached to handle 3 must be made adjustable, as well.

When the size of combustion chamber 46 is enlarged in the manner just described, it will be necessary to adjust the pressure regulating screw 107 of needle valve 106, to appropriately change the fuel/air mixture. To this end, the handle 3 could be provided with indicia (not shown) indicating the proper settings for valve 106.

It would be within the scope of the invention to use a single piston, equivalent to piston 45 in the upper cylinder, but such an arrangement would be less energy efficient.

What I claim is:

1. An internal combustion fastener driving tool comprising a housing, upper and lower coaxial cylinders located within said housing, said upper cylinder having a closed upper end and an open lower end, said lower cylinder having a closed lower end and an open upper end, said open cylinder ends being adjacent to and in communication with each other, a piston assembly in said upper cylinder, said piston assembly being shiftable between a normal retracted position adjacent said open lower end of said upper cylinder and an actuated position adjacent said closed upper end of said upper cylinder, means biasing said piston assembly to said normal retracted position, a piston/driver assembly located in said lower cylinder and comprising a piston affixed to an elongated driver, said driver extending through a perforation in said closed lower end of said lower cylinder, said piston/driver assembly being shiftable within said lower cylinder between a normal retracted position with said piston of said piston/driver assembly at said open upper end of said lower cylinder and an extended fastener driving position, said piston assembly and said piston/driver assembly when in their normal positions defining therebetween a combustion chamber, ignition means in said combustion chamber, a chamber in said housing containing pressurized combustion air, the upper end of said upper cylinder being connected to said combustion air chamber through a one-way valve, a return air chamber in said housing, the lower end of said lower cylinder being connected to said return air chamber, a source of gaseous fuel under pressure within said housing, and control means for sequentially introducing into said combustion chamber a measured amount of gaseous fuel from said source, for introducing into said combustion chamber a measured amount of air from said combustion air chamber creating an air/fuel mixture, for actuating said ignition means to combust said air/fuel mixture in said combustion chamber thereby shifting said piston assembly of said upper cylinder from its normal retracted position to its actuated position replenishing air under pressure in said combustion air chamber and thereby shifting said piston/driver assembly from its normal retracted position to its fastener driving position driving a fastener and introducing air under pressure from said lower cylinder to said return air chamber and for exhausting spent products of combustion from said combustion chamber and lower cylinder permitting said piston assembly to return to its normal retracted position under the influence of said biasing means and said piston/driver assembly to return to its normal retracted position under the influence of pressurized air from said return air chamber.

2. The tool claimed in claim 1 wherein said ignition means comprises a spark plug and a piezoelectric device electrically connected together, said piezoelectric device having an actuating means, said source of gaseous fuel comprising a replacable canister mounted in said body and containing gaseous fuel under pressure, a pressure regulating needle valve, said canister being connectable to said needle valve, a two-way fuel valve, said fuel valve having an inlet connected to said needle valve and an outlet, a one-way check valve having an inlet connected to said fuel valve outlet and an outlet connected to said combustion chamber, said fuel valve having an actuating means, a two-way air valve, said air valve having an inlet connected to said combustion air chamber and outlet connected to said inlet of said check valve, said air valve having an actuating means, a pilot-actuated exhaust valve having an inlet connected to said combustion chamber and an outlet connected to atmosphere, a two-way pilot valve for said exhaust valve, said pilot valve having an inlet connected to said return air chamber and an outlet connected to said exhaust valve, said pilot valve having an actuating means, said control means comprising said fuel valve, said air valve, said piezoelectric device and said pilot valve together with means to activate said actuators of said fuel valve, air valve, piezoelectric device and pilot valve in said timed sequence.

3. The tool claimed in claim 2 wherein said means to activate said actuators of said fuel valve, said air valve, said piezoelectric device and said pilot valve in proper timed sequence comprises a cam means.

4. The tool claimed in claim 2 wherein said actuators of said fuel valve, said air valve, said piezoelectric device, and said pilot valve each comprise a stem-like actuator, said means for activating said actuators comprises a cam assembly rotatively mounted within said housing and adjacent said actuators, said cam assembly having a cam element for and contactable by each of said actuators, a trigger, said trigger being manually shiftable between a normal unactuated position and an actuated position, spring means biasing said trigger to said unactuated position, a link means pivotally attached to said trigger and pivotally attached to said cam assembly such that as said trigger is shifted from said unactuated position to said actuated position and back to said unactuated position said cam assembly will make one complete revolution, said cam elements being so configured as to activate their respective actuator in proper timed sequence as said trigger is actuated and released and said cam assembly makes said complete revolution.

5. The tool claimed in claim 4 including port means in said upper cylinder connected to atmosphere to replenish air therein after each actuation of said piston assembly, and port means in said closed end of said lower cylinder connected to atmosphere and provided with one-way valve means to replenish air beneath said piston/driver assembly upon shifting thereof from its extended fastener driving position to its normal retracted position.

6. The tool claimed in claim 5 wherein said housing includes a handle, a guide body affixed to said housing beneath said lower cylinder, said guide body having a drive track coaxial with said cylinders, said driver of said piston/driver assembly being shiftable within said drive track, said drive track being configured to guide said driver of said piston/driver assembly and to receive a fastener to be driven by said piston/driver assembly.

7. The fastener driving tool claimed in claim 6 including a magazine, a plurality of fasteners in said magazine, and means to advance said fasteners in said magazine to locate the forwardmost fastener therein beneath said piston/driver assembly at the end of each tool cycle.

8. The fastener driving tool claimed in claim 7 including means to adjust the size of said combustion chamber and means to adjust said air-fuel mixture, whereby to adjust the power of said tool.

9. The fastener driving tool claimed in claim 7 including a plurality of washer-like elements each having a central hole, each of said fasteners being headed and mounted in said central hole of one of said washer-like elements and being supported by its respective washer-like element, frangible means connecting said washer-like element and forming a strip of said washer-like elements and their respective fasteners, whereby when each fastener is driven into a workpiece it will have its respective washer-like element beneath its head.

10. The tool claimed in claim 9 wherein said upper cylinder has a first portion and a second portion therebeneath of lesser diameter with an annular shoulder formed therebetween, said piston assembly comprises a first piston in said first cylinder portion and a second piston in said second cylinder portion, a piston rod connecting said first and second pistons, said first piston abutting said shoulder and said second piston defining a portion of said combustion chamber when said piston assembly is in normal retracted position, said biasing means comprising a compression spring having one end abutting said first piston and a second end abutting said closed upper end of said upper cylinder.

11. The fastener driving tool claimed in claim 6 including a magazine, a plurality of fasteners in said magazine and means to advance said fasteners in said magazine to located the forwardmost fastener therein beneath said piston/driver assembly in said drive track at the end of each tool cycle, said forwardmost fastener comprising a stop for said piston/driver assembly positioning said piston/driver assembly upon introduction of said air-fuel mixture into said combustion chamber to determine the size of said combustion chamber, means to shift said magazine and thus said forwardmost fastener with respect to said tool housing in directions parallel to the longitudinal axis of said piston/driver assembly to adjust the size of said combustion chamber, said needle valve comprising means to adjust said air-fuel mixture, whereby the power of said tool can be varied.

12. The tool claimed in claim 2 wherein said actuators of said fuel valve, said air valve, said piezoelectric device, and said pilot valve each comprise a stem-like actuator, said means for activating said actuators comprising a single cam element rotatively mounted within said housing and adjacent said actuators, said cam element being contactable by each of said actuators, a trigger, said trigger being manually shiftable between a normal unactuated position and an actuated position, spring means biasing said trigger to said unactuated position, a link means pivotally attached to said trigger and pivotally attached to said cam element such that as said trigger is shifted from said unactuated position to said actuated position and back to said unactuated position said cam element will make one complete revolution, said cam element being so configured as to activate each actuator in proper timed sequence as said trigger is actuated and released and said cam element makes said complete revolution.

13. The tool claimed in claim 1 including port means in said upper cylinder connected to atmosphere to replenish air therein after each actuation of said piston assembly, and port means in said closed end of said lower cylinder connected to atmosphere and provided with one-way valve means to replenish air beneath said piston/driver assembly upon shifting thereof from its extended fastener driving position to its normal retracted position.

14. The tool claimed in claim 1 wherein said housing includes a handle, a guide body affixed to said housing beneath said lower cylinder, said guide body having a drive track coaxial with said cylinders, said driver of said piston/driver assembly being shiftable within said drive track, said drive track being configured to guide said driver of said piston/driver assembly and to receive a fastener to be driven by said piston/driver assembly.

15. The fastener driving tool claimed in claim 14 including a magazine, a plurality of fasteners in said magazine and means to advance said fasteners in said magazine to located the forwardmost fastener therein beneath said piston/driver assembly in said drive track at the end of each tool cycle, said forwardmost fastener comprising a stop for said piston/driver assembly positioning said piston/driver assembly upon introduction of said air/fuel mixture into said combustion chamber to determine the size of said combustion chamber, means to shift said magazine and thus said forwardmost fastener with respect to said tool housing in directions parallel to the longitudinal axis of said piston/driver assembly to adjust the size of said combustion chamber, said needle valve comprising means to adjust said air/fuel mixture, whereby the power of said tool can be varied.

16. The fastener driving tool claimed in claim 15 including a plurality of washer-like elements each having a central hole, each of said fasteners being headed and mounted in said central hole of one of said washer-like elements and being supported by its respective washer-like element, frangible means connecting said washer-like element and forming a strip of said washer-like elements and their respective fasteners, whereby when each fastener is driven into a workpiece it will have its respective washer-like element beneath its head.

17. The tool claimed in claim 1 wherein said upper cylinder has a first portion and a second portion therebeneath of lesser diameter with an annular shoulder formed therebetween, said piston assembly comprises a first piston in said first cylinder portion and a second piston in said second cylinder portion, a piston rod connecting said first and second pistons, said first piston abutting said shoulder and said second piston defining a portion of said combustion chamber when said piston assembly is in its normal retracted position, said biasing means comprising a compression spring having one end abutting said first piston and a second end abutting said closed upper end of said upper cylinder.

18. The fastener driving tool claimed in claim 1 including a magazine, a plurality of fasteners in said magazine, and means to advance said fasteners in said magazine to locate the forwardmost fastener therein beneath said piston/driver assembly at the end of each tool cycle.

19. The fastener driving tool claimed in claim 18 including a plurality of washer-like elements each having a central hole, each of said fasteners being headed and mounted in said central hole of one of said washer-like elements and being supported by its respective washer-like element, frangible means connecting said washer-like element and forming a strip of said washer-like elements and their respective fasteners, whereby when each fastener is driven into a workpiece it will have its respective washer-like element beneath its head.

20. The fastener driving tool claimed in claim 1 wherein said air/fuel mixture in said combustion chamber is at a high compression ratio of at least about 4:1.

21. The fastener driving tool claimed in claim 1 wherein said air/fuel mixture in said combustion chamber is at a high compression ratio of at least about 6:1.

22. The fastener driving tool claimed in claim 1 including means to adjust the size of said combustion chamber and means to adjust said air/fuel mixture, whereby to adjust the power of said tool.

* * * * *